United States Patent [19]

Hoffmann et al.

[11] Patent Number: 4,651,906

[45] Date of Patent: Mar. 24, 1987

[54] ARRANGEMENT FOR APPLYING ADHESIVE MEDIUM, PARTICULARLY FOR LEATHER AND SHOE ARTICLES

[75] Inventors: Richard Hoffmann, Hechingen-Stetten; Friedrich Biedermann, Hechingen, both of Fed. Rep. of Germany

[73] Assignee: Bima Maschinenfabrik GmbH, Hechingen, Fed. Rep. of Germany

[21] Appl. No.: 794,238

[22] Filed: Nov. 1, 1985

[30] Foreign Application Priority Data

Nov. 6, 1984 [DE] Fed. Rep. of Germany ..... 3440417

[51] Int. Cl.[4] ..... B67D 5/00

[52] U.S. Cl. ..... 222/504; 222/518; 91/167 R; 92/13.7

[58] Field of Search ..... 239/583–584, 239/533.1, 533.2, 114, 536; 91/167; 92/13.7, 117 R; 251/62, 63, 63.4, 63.5; 222/504, 518, 559, 334

[56] References Cited

U.S. PATENT DOCUMENTS

| | | | |
|---|---|---|---|
| 2,806,449 | 9/1957 | Simmons | 91/167 |
| 2,831,464 | 4/1958 | Lillquist | 91/167 |
| 3,315,899 | 4/1967 | Quarve | 239/583 X |
| 4,342,443 | 8/1982 | Wakeman | 251/285 X |
| 4,392,792 | 7/1983 | Rogers | 91/167 R X |

FOREIGN PATENT DOCUMENTS 3108793 9/1982 Fed. Rep. of Germany .

*Primary Examiner*—Joseph F. Peters, Jr.
*Assistant Examiner*—Kevin Patrick Weldon
*Attorney, Agent, or Firm*—Michael J. Striker

[57] ABSTRACT

An arrangement for applying an adhesive medium, particularly for leather and shoe articles, has an adhesive medium applying nozzle and a nozzle needle member arranged to close and to open the nozzle. A driver connects one end of the nozzle needle member with a driving unit which includes at least two selectively actuatable driving devices formed with individually adjustable displacement elements so that they move the nozzle needle member selectively over different adjustable strokes.

6 Claims, 1 Drawing Figure

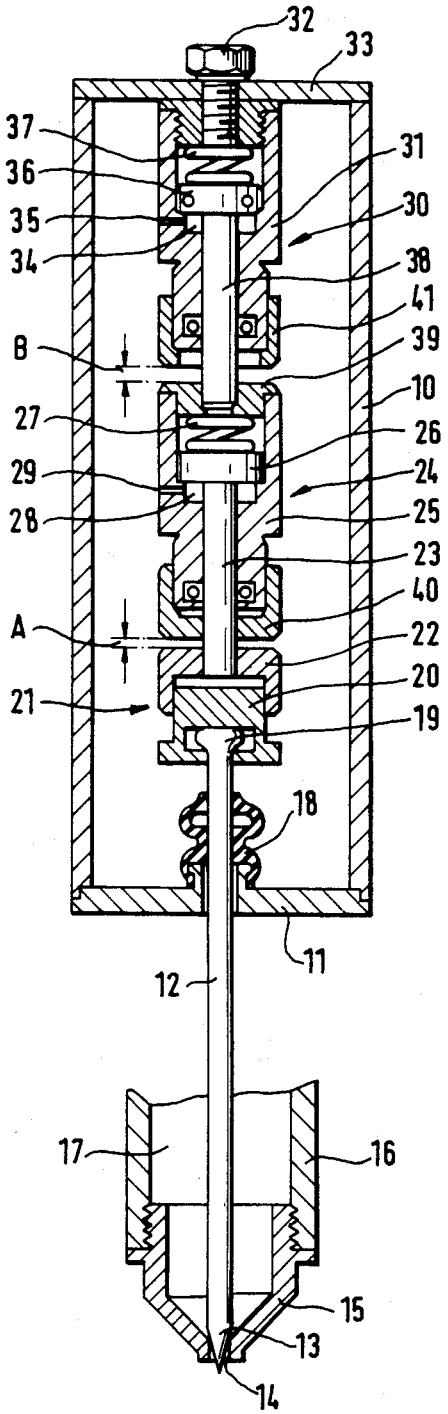
32
33
37
36
35
34
31
30
38
41
39
B
10
27
26
29
24
28
25
23
40
A
22
20
21
19
18
11
12
17
16
15
13
14

ARRANGEMENT FOR APPLYING ADHESIVE MEDIUM, PARTICULARLY FOR LEATHER AND SHOE ARTICLES

BACKGROUND OF THE INVENTION

The present invention relates to an arrangement for applying an adhesive medium, particularly for leather and shoe articles. More particularly, it relates to an arrangement for applying an adhesive medium which has an adhesive medium applying nozzle, and a nozzle needle member which closes and opens the nozzle.

Arrangements of the abovementioned general type are known in the art. In a known arrangement an adhesive medium applying nozzle cooperates with a nozzle needle member which has an end portion connected with a longitudinally displaceable driver. The driver is coupled with a driving device which respectively displaces the driver and thereby displaces the nozzle needle member relative to a nozzle needle. One of such arrangements for applying an adhesive medium is disclosed, for example, in our DE-OS 3,108,793. In practical use of such arrangements, it is frequently desirable to supply different quantities of the adhesive medium per time unit in correspondence with the various applications of the arrangement. This can be done with the known arrangements for applying an adhesive media and spraying pistols only in such a manner that different quantities of discharge adhesive medium can be adjusted manually. Such a manual adjustment is, however, complicated and very rime consuming in the event of frequent changes in the quantity of adhesive medium to be applied.

SUMMARY OF THE INVENTION

Accordingly, it is an object of the present invention to provide an arrangement for applying medium, especially to leather and shoe articles, which avoids the disadvantages of the prior art.

More particularly, it is an object of the present invention to provide an arrangement for applying an adhesive medium especially to leather and shoe articles, in which different quantities of adhesive medium can be applied easier and faster than in the known arrangements of the above-described type.

In keeping with these objects and with others which will become apparent hereinafter, one feature of the present invention resides, briefly stated, in an arrangement for applying an adhesive medium which has an adhesive medium applying nozzle, a nozzle needle member cooperating with the nozzle so as to close and to open the same, and at least two selectively actuatable drive units which act on the nozzle needle member so as to provide different strokes of the nozzle needle member.

When the arrangement for applying an adhesive medium is formed in accordance with the present invention, different quantities of adhesive medium per time unit can be applied by selective actuation of the respective drive unit for the nozzle needle member. The desired quantities of adhesive medium can be adjusted by adjusting of the individual drive units. A user no longer has to adjust the individual desired quantities in one adjusting device, but instead he just has to release the respective drive units.

In accordance with another advantageous feature of the present invention, the drive units are formed as two coaxial cylinder-piston units which can be pneumatic or hydraulic. The piston rod of one of the cylinder-piston units is connected with the cylinder of the other cylinder-piston unit, and the piston rod of the other cylinder-piston unit is connected with a displaceable driver for the nozzle needle member.

In accordance with a further feature of the present invention, the displacement paths of the pistons of the drive units can be limited by means of individual abutments so as to adjust the desired quantity of an adhesive medium to be applied per time unit.

The inventive arrangement for applying an adhesive medium is therefore used with fully automatic operation, and the time interval of operation of the drive units can be preselected in advance. Normally, the inventive arrangement for applying adhesive medium is designed for a switching impulse which is automatically limited in time and is releasable by a user.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE of the drawing is a view schematically showing a longitudinal section of an arrangement for applying an adhesive medium in accordance with the present invention.

DESCRIPTION OF THE PREFERRED EMBODIMENTS

An arrangement for applying adhesive medium in accordance with the present invention has a housing which is provided with a hollow cylindrical wall 10 and end walls 11 and 33. A nozzle needle 12 extends through the end wall 11 outwardly of the housing and has a tip 13. In the inoperative position, the tip 13 closes an outlet opening 14 of an adhesive medium applying nozzle 15. The nozzle 15 is screwed into a threaded opening of a partially shown housing part 16. The housing part 16 bounds a receiving chamber 17 for a not shown adhesive medium which is accommodated in the chamber 17 under pressure.

The nozzle needle 12 is filled from the adhesive medium receiving chamber 17 by means of a rubber seal 18. The seal 18 is tightly mounted on the inner side of the end wall 11, on the one hand, and on the nozzle needle 12, on the other hand. The nozzle needle 12 has an inner end and is widened at this end so as to form a head 19. The head 19 is retained in an adjusting screw 20. The adjusting screw 20 is a part of a longitudinally displaceable driver 21. The adjusting screw 20 extends into screw nut 22 of the driver 21. The driver 21 is mounted on an outer end of a piston rod 23 of a first cylinder-piston drive unit 24.

The piston rod 23 leads to a piston 26 which is arranged in a cylinder housing 25 of the first drive unit 24 and is acted upon at one side by a pressure air. The piston 26 is displaceable against the force of return spring 27 which is also located in the cylinder housing 25. The first drive unit 24 has a pressure chamber 28 which communicates via a connecting opening 29 and via a not shown switching device with a not shown source of pressure air.

A second drive unit 30 is arranged coaxially with the first drive unit 24. The second drive unit 30 has a cylinder housing 31 which is anchored by means of a screw 32 in the end end wall 33 of the housing 10 which is spaced from the nozzle. The cylinder housing 31 has a pressure chamber 34 which communicates via a connecting opening 35 and a not shown second switching device with the abovementioned source of pressure air. The second drive unit 30 has a piston 36 which is displaceable against the force of a return spring 37. A piston rod 38 is connected with the piston 36 and has an outer end with which it is screwed in a closing plate 39 of the cylinder housing 25, and the closing plate 39 is fixedly connected with the cylinder housing 25 of the first drive unit 24.

In both selectively actuatable drive units 24 and 30, the piston 26 of the first drive unit 24 is coupled via the driver 21 with the nozzle needle 12, while the piston 36 of the second drive unit 30 is coupled with the cylinder housing 25 of the first drive unit 24. When the first drive unit 24 is actuated by the pressure air supply into the pressure chamber 28 and its piston 26 is displaced against the force of the return spring 27, the driver 21 with the needle nozzle 12 is taken along by the piston rod 23. The displacement path of the piston 26 and thereby the displacement path of the nozzle needle 12 is limited by the value A which is determined by a first abutment nut 40 that is concentrically screwed on the cylinder housing 25.

When the second drive unit 30 is actuated by supplying pressure air into the pressure chamber 34, the piston 36 displaces via the piston rod 38 the cylinder housing 25 of the first drive unit 24 and thereby also the driver 21 with the nozzle needle 12. The displacement movement of the piston 36 of the second drive unit 30 is adjusted to a value B which is for example greater than the value A and is determined by a second abutment nut 41 mounted on the cylinder housing 31 of the second drive unit 30.

The housing 10 can accommodate more than two drive units arranged with the abovedescribed coupling, so that more than two different displacement paths for the needle nozzle 12 can be performed. The not shown switching device can be formed so that each drive unit 24 and 30 obtains a pressure impulse of an equal length which leads because of the different adjustments of the abutment nuts 40 and 41, to different displacement movements of the needle nozzle 12. On the other hand, the switching devices can be also formed so that the individual drive units 24 and 30 are actuated during different time periods. In any case, the abutment nut on the individual drive unit must be adjusted only once for feeding of the desired adhesive medium, which then can be applied by releasing of the switching device. Depending on the actuation of one or the other drive unit, the adhesive medium applying arrangement can discharge during its operation, for example on a shoe part, either a smaller or a wider adhesive medium line.

It will be understood that each of the elements described above, or two or more together, may also find a useful application in other types of constructions differing from the types described above.

While the invention has been illustrated and described as embodied in an arrangement for applying adhesive medium, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An arrangement for applying an adhesive medium, particularly for leather and shoe articles, comprising an adhesive medium applying nozzle; an elongated nozzle needle member arranged to close and to open said nozzle and having an end portion; driving means for driving said nozzle needle member; a driver which is displaceable in the longitudinal direction of said nozzle member and arranged so that said end portion of said nozzle needle member is coupled with said driving means via said driver, said driving means including at least two selectively actuatable driving devices which are formed with individually adjustable displacement means so that they can move the nozzle needle member over different adjustable strokes.

2. An arrangement for applying an adhesive medium as defined in claim 1, wherein said driving devices are formed as two coaxial hydraulic cylinder-piston units.

3. An arrangement for applying an adhesive medium as defined in claim 1, wherein said driving devices are formed as two coaxial pneumatic cylinder-piston units.

4. An arrangement for applying an adhesive medium as defined in claim 1, wherein said driving devices are formed as two coaxial cylinder-piston units, each of said cylinder-piston units having a cylinder and a piston with a piston rod, the piston rod of one of said cylinder-piston units being connected with the cylinder housing of the other of said cylinder-piston units, the piston rod of the other of said cylinder-piston units being connected with said driver, said driver being connected with said nozzle needle member; and further comprising means for adjusting the displacement strokes of said pistons of said cylinder-piston units.

5. An arrangement for applying an adhesive medium as defined in claim 4, wherein said adjusting means includes at least two displaceable abutments each arranged to adjust the displacement stroke of a respective one of said pistons.

6. An arrangement for applying an adhesive medium as defined in claim 5, wherein each of said abutments is formed as a threaded ring which is displaceably supported on a respective one of said cylinder housings, and is concentric to the latter.

* * * * *